United States Patent [19]

Jones et al.

[11] 4,357,899

[45] Nov. 9, 1982

[54] COATING APPARATUS

[75] Inventors: Dennis P. Jones, Tucson, Ariz.; David J. Pipkin, Longmont, Colo.

[73] Assignee: International Business Machines Corporation, Armonk, N.Y.

[21] Appl. No.: 325,243

[22] Filed: Nov. 27, 1981

[51] Int. Cl.[3] ..... B05C 3/18

[52] U.S. Cl. ..... 118/665; 118/673; 118/413

[58] Field of Search ..... 118/665, 672, 673, 407, 118/413

[56] References Cited

U.S. PATENT DOCUMENTS

| | | | |
|---|---|---|---|
| 3,081,191 | 3/1963 | Smith et al. | 117/64 |
| 3,936,549 | 2/1976 | Kohler et al. | 118/407 X |
| 4,327,130 | 4/1982 | Pipkin | 118/413 X |

*Primary Examiner*—John P. McIntosh

*Attorney, Agent, or Firm*—Francis A. Sirr

[57] ABSTRACT

A wide moving web is coated on one side thereof by passing the web through an elongated pool of non-Newtonian coating liquid. The pool is contained at its opposite ends by walls or dams, these dams being spaced a distance less than the width of the web, such that the side edges of the web are not coated. The dams are constructed and arranged such that the coating liquid approaches the adjacent web edge in an amount which increases as the depth of the pool of coating liquid increases. Monitoring means view the opposite side edges of the coated web. When the c. ating begins to retreat toward the center of the web, pool replenishment is increased. When the coating begins to approach the edges of the web, pool replenishment is decreased. The sensor whose coating is closest to the web edge is in control of the pump. If the coating reaches an edge of the web, the coating apparatus is stopped.

13 Claims, 8 Drawing Figures

COATING APPARATUS

DESCRIPTION

1. Technical Field

This invention relates to the field of substrate or web coating apparatus which operates to coat all but the longitudinal side edges of a traveling web.

2. Background of the Invention

The present invention relates generally to coating a wide, moving substrate or web with a non-Newtonian coating fluid or liquid by passing the web into contact with an elongated pool of such liquid, such that the part of the web being coated is itself one wall of the enclosure which forms the pool. In this manner, a portion of the liquid is carried away from the pool as a thin coating on the web. The pool thereby becomes depleted and must be replenished. It is also important that margin control, i.e., control of the coating edge relative the web edge, be maintained.

Margin control is usually achieved in the prior art by proportioning the coating station parts to achieve the desired results. Closed loop control of this coating parameter is usually not provided.

The prior art discloses a number of ways to replenish the coating liquid pool. Open loop methods involve merely supplying a constant flow to the pool, independent of the amount of liquid actually in the pool. Closed loop methods provide some means of sensing a parameter which is related in one way or another to the amount of liquid in the pool. An example of the latter is a replenishment pump whose pumping rate is a function of the speed of travel of the web. A more direct method uses a float-like device to measure the height of liquid within the pool.

The present invention provides both closed loop margin control and closed loop liquid replenishment by the use of a single means.

The present invention utilizes a direct sensing means, but does not require positioning a sensor at or in the coating liquid pool.

SUMMARY OF THE INVENTION

The present invention finds particular utility in the manufacture of flexible magnetic recording media.

In such a manufacturing process, the web may comprise a wide web of biaxially oriented polyethylene terephthalate, acetates, polyolefins, or other conventional polymeric films which are in the range of 0.0015 inch thick, and are from 24 inches to 48 inches in width. The "magnetic ink" to be coated onto at least one side of such a substrate may vary widely in formulation. However, in all known instances, this ink is a non-Newtonian fluid, i.e., a fluid whose viscosity changes with rate of flow. Such fluids have also been described as thixotropic and pseudoplastic fluids.

In coating such a wide web, it is preferable that the volume of ink in the coating nip be relatively small, and that the ink be shielded from the effects of evaporation and contamination as much as is possible. Thus, it is advantageous to provide direct sensing of the need to replenish the pool, without providing a sensor in or at the location of the pool.

The present invention accomplishes this result by a construction and arrangement which automatically provides a change in the width of the web's coating, as a function of the height of coating liquid in the pool. Thus, the sensing of this width parameter can be used to control pool replenishment, and in addition, the resulting pool replenishment controls the web's coating width parameter.

More specifically, the present invention provides an elongated or linear pool, which for example is about 22 inches long when coating a 24-inch wide web. The two long sides or walls of the pool are made up of the coating head and the web being coated, respectively. The two ends of the pool are made up of two small wedge-shaped walls or dams.

In accordance with two embodiments of the present invention, these dams are constructed and arranged to allow the coating ink to leak out beyond the dam in a decreasing amount as the level of the ink in the dam decreases. Two sensors are located downstream of the coating head. The sensors are associated with the opposite side edges of the web, and the width of the narrowest of the uncoated side edges is used to control replenishment of ink to the pool.

In accordance with a third embodiment of the present invention, these dams are inclined or sloped so as to provide a wider pool as the height of the liquid in the pool increases. In this embodiment, the liquid preferably does not leak out beyond the dam, toward the web edges. However, this third embodiment may also provide leakage which is variable with liquid level, if desired.

As a safety feature, should the web be coated completely to an edge, an alarm or the like is actuated.

In this manner, the level of coating liquid within the pool is maintained, and a desired width of the web is coated.

The foregoing and other features and advantages of the invention will be apparent from the following more particular description of preferred embodiments of the invention, as illustrated in the accompanying drawing.

DESCRIPTION OF THE PREFERRED EMBODIMENTS

The present invention will be described in the environment of a preferred coating apparatus. However, the present invention finds utility in any coating apparatus wherein a pool of coating liquid must be replenished.

Figure 1:
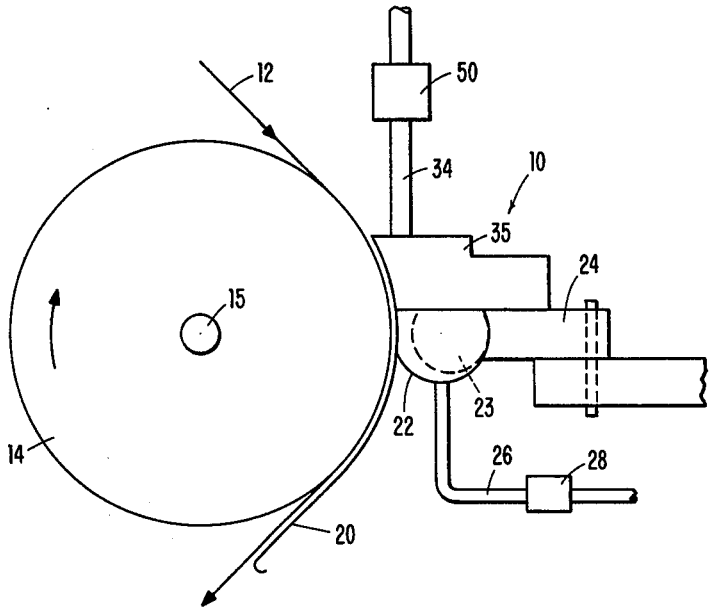
FIG. 1 is a simplified side view of a pool type coating apparatus in accordance with the present invention.

FIG. 1 shows the present invention used with the coating apparatus of copending and commonly assigned U.S. patent application Ser. No. 207,571, filed Nov. 17, 1980, herein incorporated by reference.

For purposes of showing the utility of the present invention with yet another pool-type coating apparatus, reference may be had to U.S. Pat. No. 3,081,191.

As shown in FIG. 1, coating apparatus 10 engages web 12 at backup roller 14. Roller 14 is mounted for rotation on axis 15 and is driven at the line speed at which web 12 is moving. Roller 14 is an exemplary 6 inches in diameter, 13.75 inches in axial length, is a circular cylinder, and is made of highly polished metal. Guide rollers, not shown, direct web 12 into contact with at least a substantial portion of the periphery of backup roller 14.

A smoothing film 20 is positioned in an essentially stationary, static fashion adjacent web 12 and a portion thereof extends around the periphery of backup roller 14. Preferably, smoothing film 20 extends over a substantial portion of the circumferential portion of web 12 which is in contact with backup roller 14, and extends beyond such contact. Pressure generating means such as pliable membrane 22, carried on metal mandrel 23 and secured to support 24, urges smoothing film 20 into contact with web 12 with a predetermined static force which is a function of the internal pressure within membrane 22. Membrane 22 is tubular in shape, an exemplary 1.5 inches in diameter, is somewhat longer than film 20 is wide. The tubular axis of membrane 22 extends parallel to the axis of roller 14 for all positions of the membrane. Support 24 preferably allows for movement toward and away from backup roller 14 to vary the circumferential conformance length of membrane 22 to roller 14. For a fixed line speed, the greater the length of membrane conformance, the longer will be the coating zone, as measured in the direction of web travel, and the longer will be the residence time of the web in the coating zone.

Conduit 26 communicates with the interior of membrane 22 and also with pressure regulating means 28 to supply a fluid, preferably air, to the interior of membrane 22. Thus, by regulating the internal pressure of membrane 22, the pressure generating means urges smoothing film 20 into contact with web 12 at a desired static force which may be readily regulated by pressure regulating means 28.

A metering pump 50 provides coating liquid to input conduit 34. Pump 50 operates to pump coating liquid at a nominal rate. As will be described, this rate can be increased or decreased, to both maintain a desired level of liquid within the coating pool, and to control the width of the uncoated side margins of the web. If desired, pump 50 can be operated in an on-off mode; however, modulation of the pumping rate about a nominal rate is preferred. Manifold 35 contains a reservoir or pool of coating liquid at the confluence of web 12 and smoothing film 20.

Figure 2:
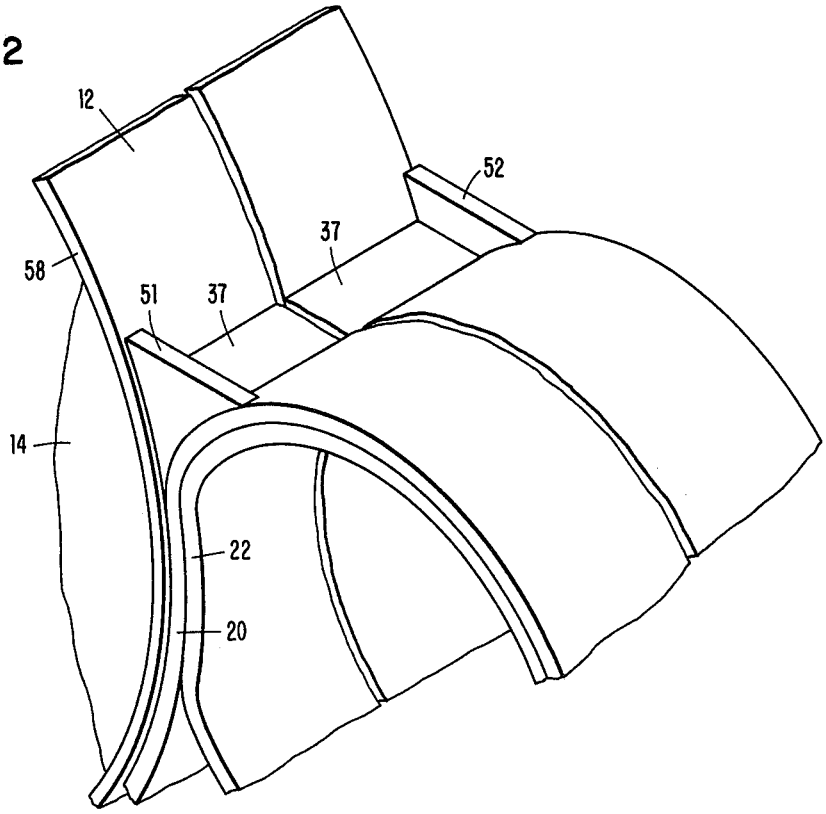
FIG. 2 shows the coating nip of FIG. 1, the location of the pool of coating liquid, and the location of the pool's two end-disposed dams.

FIG. 2 shows the aforementioned pool or reservoir 37 of coating liquid at the confluence of smoothing film 20 and web 12. This pool provides a readily controllable coating on web 12 with, in essence, force generated by membrane 22 controlling the thickness of the coating and the rate of resupply of the coating liquid controlling the width of the coating. The primary function of stationary smoothing film 20 is to provide an area of high shear force to the coating liquid, this in turn generating high hydrodynamic pressure, to thus spread and smooth the liquid coating material to a uniform thickness along the web's length. As web 12 emerges from smoothing film 20, a coated substrate is provided with liquid coating material evenly dispersed across the face of web 12 in a smooth and reproducible manner, and without a flow of surplus liquid coating material at the trailing end of smoothing film 20.

As seen in FIG. 2, pool 37 is constrained at its opposite edges by wedge shaped walls 51 and 52 of plastic material. The front face of these walls or dams slidably approach, but do not touch, moving web 12, whereas the rear face of these walls engages stationary smoothing film 20. These walls are supported from above, by attachment to FIG. 1's manifold 35.

The construction and arrangement of dams 51 and 52 can take a variety of forms within the generic teaching of the present invention. The only requirement is that the width of the web which is coated must increase as the quantity (i.e., height) of liquid in pool 37 increases.

Figure 3:
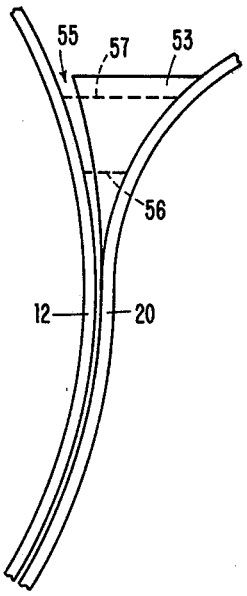
FIG. 3 is a side view of a tapered-gap type of dam used in one embodiment of the present invention.

In one form, a dam constructed and arranged in accordance with the present invention may be as shown in FIG. 3. Here a dam wall 53 is shown whose front face 54 is not concentric with FIG. 1's roller 14. As a result, a tapered gap 55 is formed between the dam's front face and moving web 12. An exemplary low-level pool is shown at 56, and an exemplary high-level pool is shown at 57. Thus, it can be seen that more coating liquid will leak out past the dam's front face when level 57 exists than does when level 56 exists.

As can be readily appreciated, when more liquid leaks out beyond the dam, the width of the coating approaches the side edge 58 (FIG. 2) of moving web 12. By way of example, gap 55 may be 0.050 inch wide at its widest portion, as measured between the dam's front face and web 12. The front face 54 of dam 53 is 0.50 inch wide, for example, measured in a direction parallel to the axis of roller 14.

Figure 4:
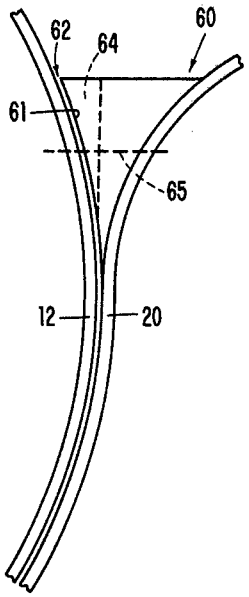
FIGS. 4 and 5 are a side and a front view, respectively, of a constant-gap, variable width dam used in another embodiment of the present invention.
Figure 5:
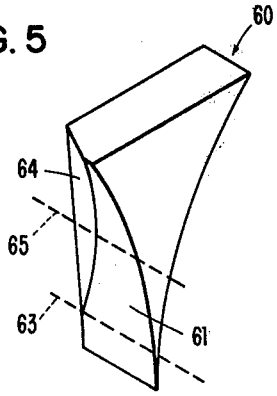

FIGS. 4 and 5 show another dam, constructed and arranged in accordance with the present invention, which provides a constant gap between the dam's front face and web 12, but here the width of the gap (as measured parallel to the axis of roller 14) progressively decreases from the bottom to the top of the dam.

More specifically, dam 60 is provided with a rear face substantially identical to the rear face of dam 53. The front face 61 of dam 60 is shaped concentric with roller 14 to thereby form a constant gap 62 to moving web 12. This gap is an exemplary 0.010 inch.

As best seen in FIG. 5, the front face 61 of dam 60 is a uniform 0.50 inch wide up to level 63. At this point, an inclined or beveled plane 64 is formed such that the coating liquid experiences less resistance to leakage through gap 62 as the level of liquid in the pool increases.

In an exemplary construction, plane 64 is beveled less than 5° to the front face of dam 60. In practice it is desirable to control the pool level to a mid position in plane 64, such as at 65, so that control of pump 50 (FIG. 1) can be to either increase or decrease the pumping rate, as the level drops below or moves above level 65, respectively.

In both of the dam members above described, the gap between the dam's front face and the moving web is never wide enough to allow unrestricted flow beyond the dam's face even when the pool is at its highest level, and for example the web is stationary. The liquid's rheology or surface tension will prevent liquid from migrating completely across the dam's front face before the liquid is carried away by the moving web. However, subsequently the liquid will flow toward the web's opposite side edges, and this effect is accelerated by operation of smoothing flap 20.

Figure 6:
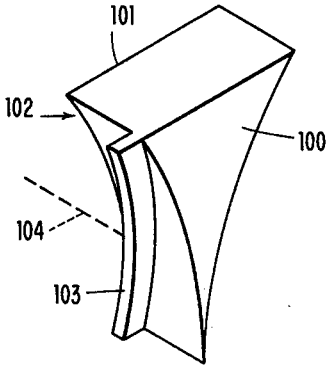
FIG. 6 is a view of a sloped dam used in another embodiment of the present invention.

FIG. 6 shows an embodiment of the present invention which may or may not provide leakage past the pool's oppositely disposed dam members. In its fundamental form, the embodiment of FIG. 6 operates to coat a wider width of the web, as a function of the height of liquid in the coating pool, by providing a wider pool as the liquid height increases. In this dam member the side walls 100 and 101 are vertical. The dam's front face 102 cooperates with moving web 12 and its vertical wall 101 forms one end of the coating liquid pool, for example, as the FIG. 6 dam member replaces dam member 51 of FIG. 2. The operative portion of front face 102 is inclined, or sloped, protruding wall 103. This wall establishes the operative width of the coating liquid pool, and operates to expose a wider portion of web 12 to the coating liquid as the height of liquid within the pool increases. In an exemplary embodiment of the FIG. 6 arrangement, the width of the web's coating can be controlled $\pm\frac{1}{4}$ inch about a nominal value, which nominal is achieved when the level of liquid is at midposition on wall 103, represented by dotted line 104. In this embodiment of the present invention, the other end of the pool (i.e., at the position of FIG. 2's dam 52) includes a similar dam member whose sloped wall 103 is oppositely inclined.

If desired, the construction and arrangement of the front face of sloped wall 103 can include the liquid leakage arrangements of FIGS. 3 or 4–5.

Figure 7:
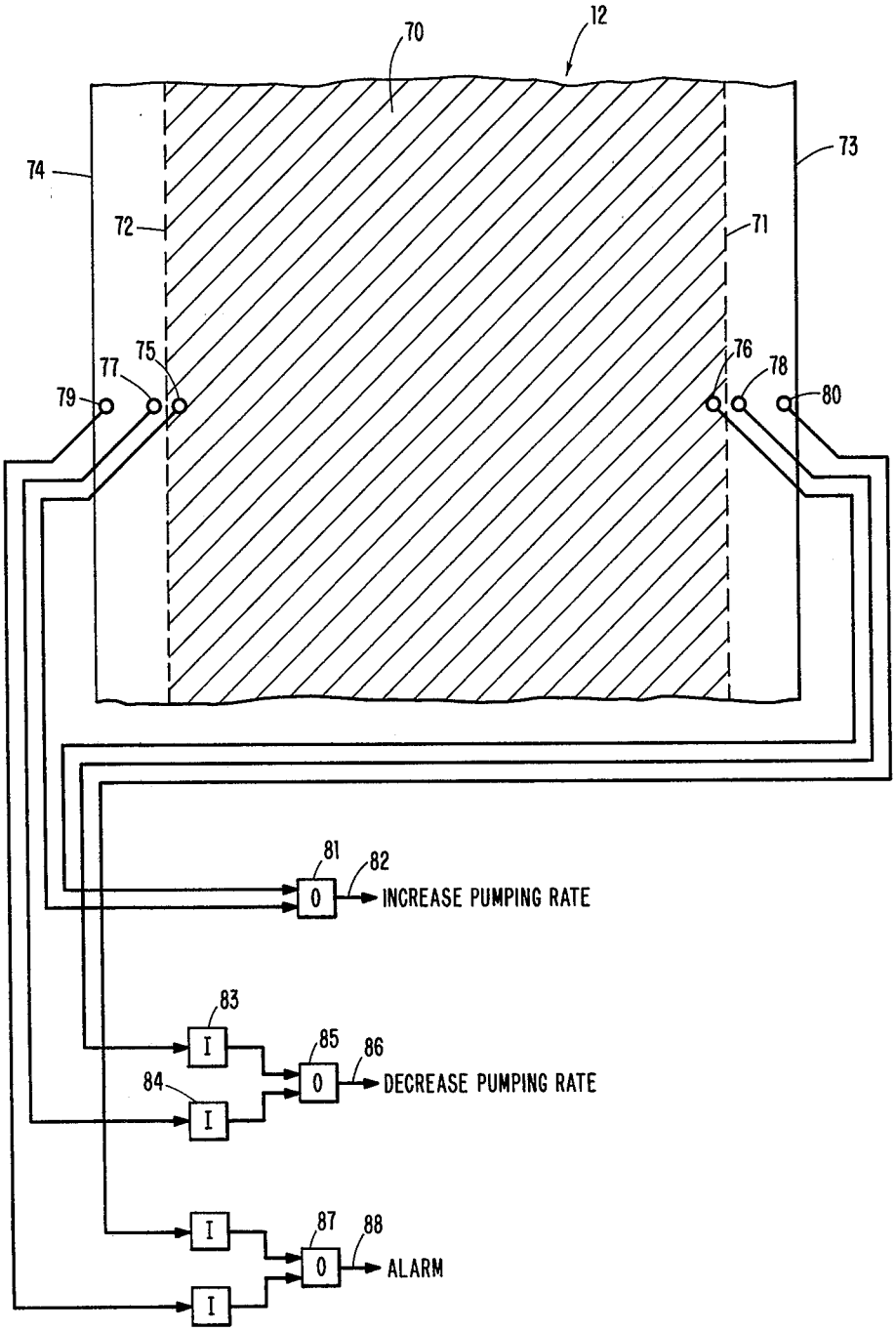
FIG. 7 is a first closed loop control scheme.

FIG. 7 shows a simple means for sensing the width to which FIG. 1's web 12 is coated. In this figure web 12 is viewed from its coated side downstream of the FIG. 1 coating station. The figure's crosshatched area 70 designates the coating placed on the web by the coating station. The two side edges of this coating are shown at 71 and 72, whereas the side edges of web 12 are shown at 73 and 74. In other words, the two web portions 71, 73 and 72, 74 are uncoated.

Six aligned photocells 75–80 are spaced closely to web 12, but do not physically contact the same, as shown. These light responsive devices are sensitive to either light reflected off coating 70 and the uncoated portions of the web, or alternatively light transmitted through the same. A light source means, not shown, provides the reflected or transmitted light.

Photocells 75 and 76 are arranged to control FIG. 1's pump 50. When either of photocells 75 or 76 detects a magnitude of light above a given magnitude, OR circuit 81 is enabled and "increase pumping rate" signal 82 operates to increase the pumping rate of pump 50. As a result, the quantity of coating liquid within pool 37 increases, and one or both of the coating edges 71, 72 begins to move toward its adjacent web edge 73, 74, respectively.

As one or both of the coating edges 71, 72 reaches its adjacent photocell 78, 77, respectively, the amount of light received by that photocell will decrease. This decrease in signal is inverted by the related one of inverters 83 and 84. As a result, OR 85 is enabled and "decrease pumping rate" signal 86 is then operable to reduce the pumping rate of FIG. 1's pump 50.

In the event that one of the coating edges 71, 72 should inadvertently reach the position of its related photocell 80, 79, respectively, a reduction in light received by that operative photocell enables OR 87, thereby activating "alarm" signal 88. Such a signal could be used to stop movement of web 12 and/or operation of pump 50.

Figure 8:
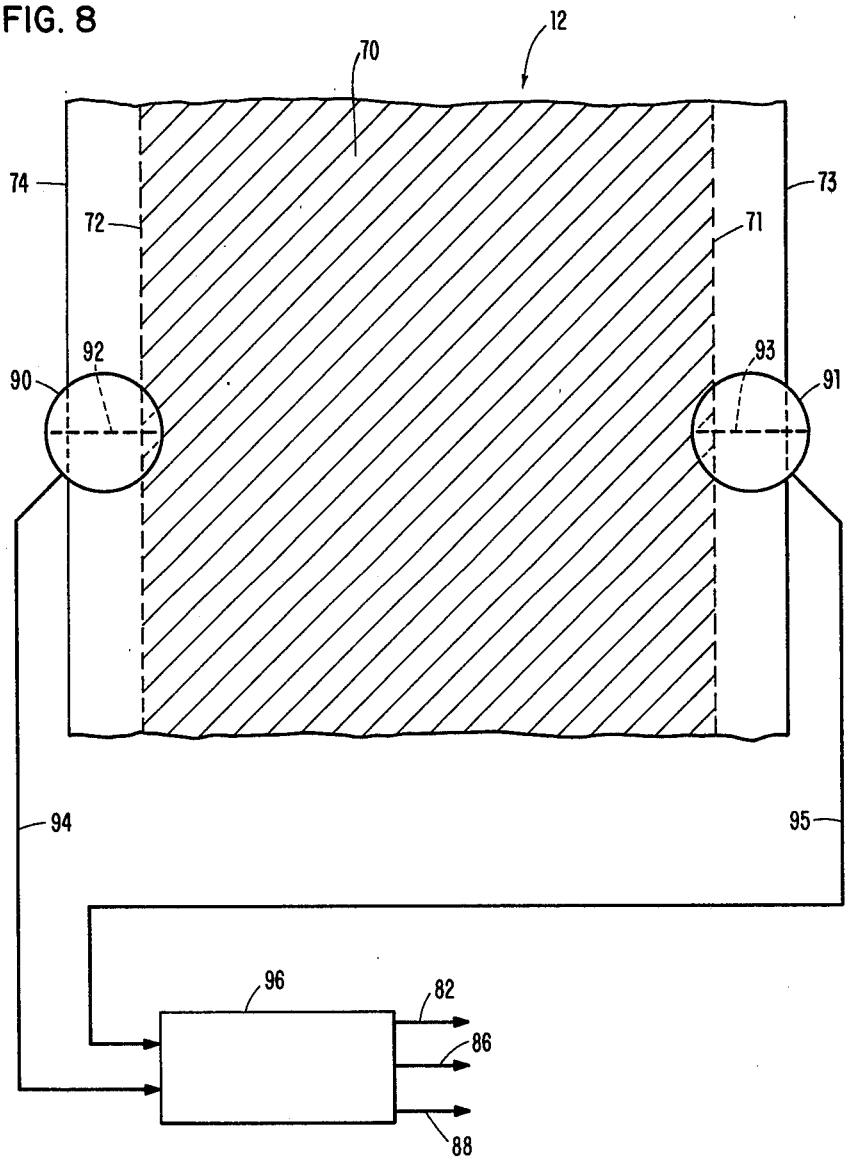
FIG. 8 is a second closed loop control scheme.

An alternative, more complex but more accurate, control scheme is shown in FIG. 8. Here the photocells are replaced by two light sensitive viewing cameras 90 and 91 whose viewing reticles 92 and 93 provide fine-resolution signals 94 and 95 which define the uncoated widths 71, 73 and 72, 74 of web 12. Signals 94 and 95 are connected as inputs to programmable controller 96, this controller being programmed to provide signals 82, 86 and 88, as aforesaid.

By way of a more specific example, cameras 90 and 91 may be the Reticon LC 600 Line Scan Camera by EG & G Company, and controller 96 may be the Reticon RS 8500 Camera Processor by that same company.

The new and unusual results achieved by the present invention can be seen by assuming that one desires to change the width to which the web is coated. In the FIG. 7 embodiment, this is achieved by moving photocells 76–78 and 75–77 transverse of web 12, i.e., horizontally as shown in FIG. 7. In the FIG. 8 embodiment, this is achieved by programming controller 96 to interrogate a different portion of viewing reticles 92 and 93. In both cases, the pumping rate of pump 50 will be changed, and the pool height will be maintained at a different level, in order to satisfy the new closed loop control command that the web be coated to a width determined by the new positions of the photocells, or the new portion of the reticles which are being sensed.

While the invention has been particularly shown and described with reference to preferred embodiments thereof, it will be understood by those skilled in the art that various changes in form and details may be made therein without departing from the spirit and scope of the invention.

What is claimed is:

1. In a coating apparatus whereat a web of material passes through a coating station and at least one surface of the web encounters a pool of coating liquid, the web thereafter leaving the coating station bearing a coating of said liquid on all but at least one side edge of said web surface, the improvement comprising:

a wall member associated with said pool and acting as a dam to contain said pool adjacent said one side edge of said web, said dam being constructed and arranged to allow a greater width of said web to be coated as the liquid level in the pool rises, a rise in said liquid level thereby producing a coating on the web which moves toward said side edge of the web as the liquid level in the pool rises;

replenishment means for replenishing coating liquid to said pool; and sensing means associated with said web downstream of the coating station, said sensing means being responsive to the position of the coating relative said side edge of the web, and being connected to control said replenishment means.

2. The coating apparatus defined in claim 1, including a second similar wall member associated with the opposite end of said pool, second sensing means associated with the opposite side edge of said web, and means coordinating operation of said first and second sensing means to insure that the sensor whose coating is the closest to its web edge is placed in control of said replenishment means.

3. The coating apparatus of claim 2 including further means coordinating operation of said first and second sensing means and responsive to at least one of said sensors indicating coincidence or the like of the edge of said web and said coating.

4. The coating apparatus defined in claim 1 wherein said dam is constructed and arranged to allow a greater amount of coating liquid to pass or leak between the dam and the web as the liquid level in the pool rises.

5. The coating apparatus defined in claim 4, including a second similar wall member associated with the opposite end of said pool, second sensing means associated with the opposite side edge of said web, and means coordinating operation of said first and second sensing means to insure that the sensor whose coating is the closest to its web edge is placed in control of said replenishment means.

6. The coating apparatus of claim 5 including further means coordinating operation of said first and second sensing means and responsive to at least one of said sensors indicating coincidence or the like of the edge of said web and said coating.

7. The coating apparatus of claim 1 wherein said wall member includes a front face adjacent said web, said front face forming a leakage gap to said web which is of decreasing dimension as the quantity of liquid in said pool decreases.

8. The coating apparatus of claim 1 wherein said wall member includes a front face adjacent said web, said front face forming a constant-dimension leakage gap to said web, with the leakage width of said gap increasing in dimension as the quantity of liquid in said pool decreases.

9. The coating apparatus of claim 7 or 8 including a second similar wall member associated with the opposite end of said pool, second sensing means associated with the opposite side edge of said web, and means coordinating operation of said first and second sensing means to insure that the sensor whose coating is the closest to its web edge is placed in control of said replenishment means.

10. The coating apparatus of claim 7 or 8 including a second similar wall member associated with the opposite end of said pool, second sensing means associated with the opposite side edge of said web, and means coordinating operation of said first and second sensing means to insure that the sensor whose coating is the closest to its web edge is placed in control of said replenishment means; and responsive to at least one of said sensors indicating a close proximity of the coating to its edge of said web to provide an indication thereof.

11. The coating apparatus defined in claim 1 wherein said dam is constructed and arranged to provide a wider pool, measured transverse to said web, as the liquid level in the pool rises.

12. The coating apparatus defined in claim 11, including a second similar wall member associated with the opposite end of said pool, second sensing means associated with the opposite side edge of said web, and means coordinating operation of said first and second sensing means to insure that the sensor whose coating is the closest to its web edge is placed in control of said replenishment means.

13. The coating apparatus of claim 12 including further means coordinating operation of said first and second sensing means and responsive to at least one of said sensors indicating coincidence or the like of the edge of said web and said coating.

* * * * *